United States Patent [19]

Kopp

[11] 4,404,758

[45] Sep. 20, 1983

[54] SKIING BOOT

[75] Inventor: Ernst Kopp, Graz, Austria

[73] Assignee: Skischuhfabrik Dynafit Gesellschaft m.b.H., Graz, Austria

[21] Appl. No.: 341,788

[22] Filed: Jan. 22, 1982

[30] Foreign Application Priority Data

Jan. 26, 1981 [AT] Austria ..... 312/81

[51] Int. Cl.[3] ..... A43D 5/04

[52] U.S. Cl. ..... 36/121

[58] Field of Search ..... 36/121, 117, 118, 119, 36/120

[56] References Cited

FOREIGN PATENT DOCUMENTS 2428413 2/1980 France ..... 36/121

*Primary Examiner*—Patrick D. Lawson

*Attorney, Agent, or Firm*—Fleit, Jacobson, Cohn & Price

[57] ABSTRACT

A skiing boot having a lower shell, which substantially encloses the foot, a gaiter, which is hinged to the lower shell adjacent to the ankle, and a device for adjusting the inclination of the gaiter relative to the lower shell and to exert a force which opposes the forward pivotal movement of the gaiter. Projections or similar holders are respectively provided on the rear portion of the lower shell and on the rear portion of the gaiter, in a manner known per se. An adjusting screw having oppositely handed screw threads is provided between said projections and an adjusting wheel is mounted on said screw between its screw threads. A guide pin is longitudinally slidably mounted on the projection of the gaiter and interengages with the adjusting screw and carries a biasing spring or the like.

6 Claims, 1 Drawing Figure

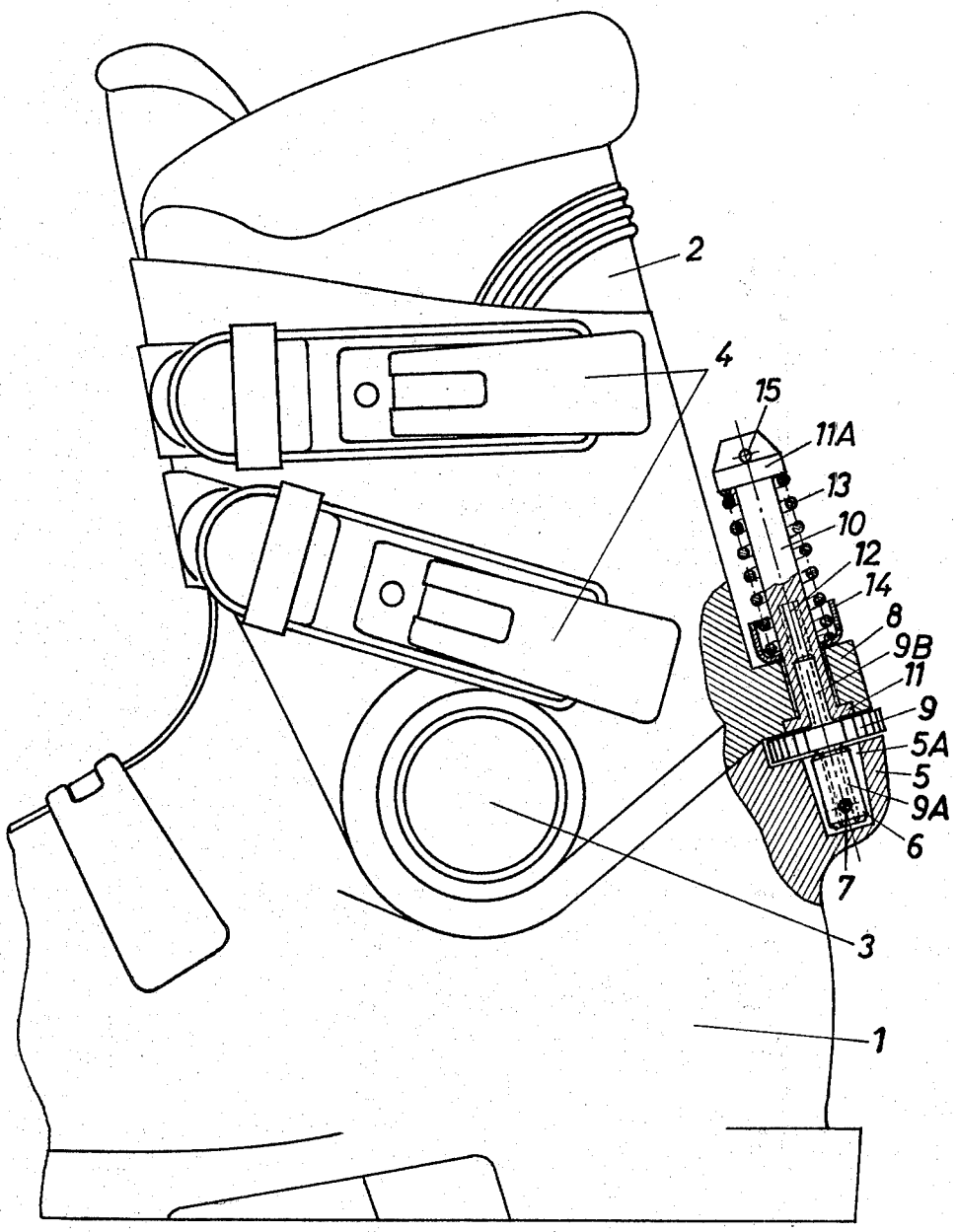
2
4
15
11A
13
10
12
14
8
9B
11
9
5A
5
9A
6
7
3
1

SKIING BOOT

SUMMARY OF INVENTION

A skiing boot having a lower shell and a gaiter, which is hinged to the lower shell and connected to the latter by an adjusting screw, which has two oppositely handed screw threads and an adjusting wheel between said screw threads. The upper end portion of the adjusting screw extends into a spring-loaded pin. The lower end of the adjusting screw extends into a pivoted tapped sleeve. Said pin has a stop, which defines the rearmost position of the gaiter.

This invention relates to a skiing boot comprising a lower shell, which substantially encloses the foot, and a gaiter, which is hinged adjacent to the ankle to be pivotally movable in the longitudinal direction of the foot within a shiftable range.

In skiing boots of the kind described the lower leg should be held as exactly and rigidly as possible against a movement that is transverse to the longitudinal direction of the foot. On the other hand, an adequate freedom of movement of the lower leg in the longitudinal direction of the foot is desired. During skiing, the gaiter should be movable to the rear only to a defined limit so that a further rearward movement of the lower leg will be prevented and the skier will have a rear support as he shifts his center of gravity to the rear for a swing. The forward movement should also be limited by the gaiter because the strong forces of inertia exerted during skiing may result in an excessive forward inclination of the lower leg and this may damage the upper ankle joint. The resistance to the forward movement of the gaiter within the range of its pivotal movement should desirably increase progressively. The optimum position of the range of pivotal movement relative to a vertical axis depends on the motion of the skier and on the skiing technique preferred by him. Racers and skiers using racing techniques usually employ a larger forward lean than recreational skiers. Besides, more highly trained skiers usually employ a larger forward lean than, e.g. beginners.

The desirable forward lean is also restricted by the fact that skiing boots must also permit the wearer to walk and to stand upright without skis on his feet. If the rear limit of the range of pivotal movement is distinctly in front of the vertical, the upper edge of the gaiter will be forced into the calf of the leg and this will result in considerable pain after some time. Besides, the leverage will cause the foot to be pushed forward in the lower shell so that the toes will be compressed in the toecap of the lower shell.

It has repeatedly been proposed to eliminate these disadvantages in that suitable means are provided to adjust the range of pivotal movement of the gaiter.

German Opened application No. 2,057,094 discloses a device which can be mounted on a skiing boot and can be used to limit the range of the pivotal movement of the gaiter relative to the lower shell. In accordance with that publication a connecting rod is pivoted to the lower shell at a bracket and is axially slidable in a housing, which is hinged to the gaiter. The housing contains a double-acting compression spring, which receives a stop that is rigidly connected to the connecting rod. The end faces of the housing constitute stops, which limit the pivotal movement in both directions. The bracket on the lower shell is provided with position-adjusting means, such as detent pins adapted to snap into different holes, or adjusting screw threads.

That device involves relatively high manufacturing costs and its mounting on the skiing boot is a complicated operation. The adjustment by means of detent pins cannot readily be effected particularly when the hands are protected by mittens. The detent pins are so small that they cannot easily be grasped. Besides, they may easily be lost. Where adjusting screw threads are provided, the adjustment effected by each revolution of the adjusting nut will amount only to the lead of the screw threads so that a substantial adjustment will take a relatively long time. This will be undesirable particularly when the adjustment is effected to make standing or walking without skis more comfortable, e.g. when the skier is waiting at a ski lift.

It is an object of the invention to provide a skiing boot in which the range of pivotal movement of the gaiter can be adjusted by means which are at least in part integrated in the skiing boot and which can be manufactured simply and at low costs and can readily be mounted and permit of a quick and convenient adjustment.

This object is accomplished according to the invention in that adjusting mechanism comprises a tapped sleeve, which is pivoted to the lower shell in the plane in which the gaiter is pivotally movable, a guide pin, which is mounted in a projection of the gaiter for an axial movement in the plane in which the gaiter is pivotally movable, which guide pin carries a stop collar adjacent to each end and is provided in the end facing the lower shell with a blind tapped hole, an optional buffer element provided between the projection and the upper stop collar, and an adjusting wheel which is provided between the tapped sleeve and the guide pin and carries concentric screw-threaded pins protruding from the end faces of the adjusting wheel and mounted in the tapped sleeve and the blind hole, respectively, wherein one of the screw-threaded pins carries left-hand screw threads and the other carries right-hand screw threads.

The invention will now be explained with reference to the drawing, in which a preferred embodiment is shown in a side elevational showing the heel portion of the skiing boot viewed onto the outer side.

The lower shell 1 is connected to the gaiter 2 by a hinge 3. Fastening buckles 4 are provided on the gaiter 2. The lower shell 1 is provided at its rear with a projection 5, which is formed with an open-topped, conically flaring blind hole 5A. A tapped sleeve 6 is pivoted on a pivot pin 7 in the blind hole 5A but may be mounted in a different manner within the scope of the invention. The gaiter 2 carries a projection 8, which has a through bore, in which a guide pin 10 is freely slidably mounted. The guide pin 10 is provided with stop collars 11 and 11A at opposite ends. The upper stop collar 11A consists of a stop cap, which is removable and has been fixed with a fixing pin 15. At that end which faces the lower shell the guide pin 10 is formed with a tapped blind bore 12. An adjusting wheel 9 is provided between the projections 5 and 8 and carries two co-axial screw-threaded pins 9A and 9B, which protrude from opposite end faces of the wheel 9 and mesh with the screw threads of the tapped sleeve 6 and the blind bore 12, respectively. The screw-threaded pins 9A and 9B are provided with right-hand and left-hand screw threads, respectively. A helical compression spring 13 which is concentric to the guide pin 10 is disposed between the stop collar 11A and the projection 8 of the gaiter 2 and is provided with a spring socket 14. That spring 13 serves as a buffer opposing the pivotal movement of the gaiter 2. A recess for receiving the stop collar 11 of the guide pin 10 is formed in the bottom surface of the projection 8 of the gaiter.

It is apparent that in accordance with the invention the force-applying parts of the adjusting device are integrated in the lower shell and in the gaiter so that conventional plastics technology permits these parts to be made in a design which is desirable in view of the material employed and results in a pleasing appearance. Because separate components are not required, the device according to the invention can be made at low cost.

The adjustment is effected by a turning of the adjusting wheel. Because there are left-hand screw threads on one side of the adjusting wheel and right-hand screw threads on the other side, the adjustment effected per revolution is twice the lead of the screw threads. The periphery of the adjusting wheel 9 is readily accessible on three sides so that it can be conveniently actuated even with mittens. It is apparent that the adjustment can be effected in one-half of the time and more conveniently than in the arrangement described hereinbefore. The pivotal movement of the gaiter is limited by the cooperation of the projection 8 with the stop collars 11 and 11A of the guide pin 10. It is desirable but not essential to provide an interposed buffer element 13, which preferably consists of a helical compression spring that is concentric to the guide pin 10 although buffer elements of any desired other design may also be used.

What is claimed is:

1. A skiing boot comprising a lower shell which substantially surrounds the foot, a gaiter hinged to the lower shell near the ankle, means for adjusting the inclination of the gaiter relative to the lower shell and for exerting a force opposing the forward pivotal movement of the gaiter, said lower shell and said gaiter having a rear portion each, each of the two rear portions of the lower shell and the gaiter having a holder, an adjusting screw being provided between said holders and comprising oppositely handed screw threads and an adjusting wheel fixed between said screw threads, and a guide pin being longitudinally slidably held on said holder of said gaiter, which guide pin interengages with said adjusting screw and carries resilient means.

2. A skiing boot as set forth in claim 1, wherein the projection of the lower shell has an upwardly flaring blind hole, which receives a tapped sleeve, which receives one end of the adjusting screw, and said tapped sleeve is pivoted in said blind hole by means of a pivot pin, which extends transversely to the longitudinal direction of the boot.

3. A skiing boot according to claim 1, characterized in that said guide pin has at one end a tapped blind bore for receiving the other end of said adjusting screw, and a flange which cooperates with the underside of said holder of the gaiter, and the guide pin is provided at its other end with a cap, which is detachably mounted by means of a crosspin and serves as an abutment for said resilient means.

4. A skiing boot according to claim 3, characterized in that a recess for said flange is formed in the bottom surface of said holder of the gaiter.

5. A skiing boot according to claim 1, characterized in that said holders consist of projections.

6. A skiing boot according to claim 1, characterized in that said resilient means consist of a spring.

* * * * *